US005282613A

United States Patent [19]

Standerfer et al.

[11] Patent Number: 5,282,613

[45] Date of Patent: Feb. 1, 1994

[54] SIGNATURE STREAM FEEDING APPARATUS

[75] Inventors: James F. Standerfer, Sullivan; Gilbert D. Cisney, Hidalgo, both of Ill.

[73] Assignee: R. R. Donnelley & Sons Company, Lisle, Ill.

[21] Appl. No.: 953,991

[22] Filed: Sep. 29, 1992

[51] Int. Cl.[5] ..... B65H 29/66

[52] U.S. Cl. ..... 271/202; 271/270; 271/151; 198/461

[58] Field of Search ..... 198/461; 271/270, 198, 271/199, 202, 216, 150, 151

[56] References Cited

U.S. PATENT DOCUMENTS

| | | | |
|---|---|---|---|
| 3,945,633 | 3/1976 | Knopp | 271/202 |
| 3,945,635 | 3/1976 | Marin | 271/202 |
| 4,008,890 | 2/1977 | Pulda et al. | 271/151 |
| 4,049,260 | 9/1977 | Szymborski | 271/151 |
| 4,451,967 | 6/1984 | Stobb | 29/564.3 |
| 4,588,180 | 5/1986 | Ballestrazzi et al. | 271/199 |
| 4,861,014 | 8/1989 | Martin | 271/190 |
| 4,973,038 | 11/1990 | Curley et al. | 271/150 |
| 5,026,038 | 6/1991 | Weller et al. | 271/3.1 |

*Primary Examiner*—H. Grant Skaggs
*Attorney, Agent, or Firm*—Wood, Phillips, VanSanten, Hoffman & Ertel

[57] ABSTRACT

In order to accommodate either a loose lift of signatures or, alternatively, a signature log for the purpose of stream feeding a supply of signatures to a packer box on a binding line in an effective and efficient manner, a signature stream feeding apparatus is disclosed which includes an upstream conveyor, an intermediate conveyor, and a down stream conveyor. The upstream conveyor receives and supports signatures in a generally upright position on the fore edges or backbones thereof, and it is downwardly inclined relative to the horizontal in the direction of signature travel therealong. The intermediate conveyor then receives the signatures from the upstream conveyor and conveys them toward the packer box, and it is inclined upwardly and away from the upstream conveyor in the direction of travel of the signatures therealong. The downstream conveyor finally receives the signatures from the intermediate conveyor and conveys them toward the packer box, and it extends between the packer box and the intermediate conveyor. By utilizing an upstream conveyor, an intermediate conveyor, and a downstream conveyor having these characteristics, the conveyors may be controlled to transform the signatures into a shingled stream at the intermediate conveyor and into a thinner shingled stream at the downstream conveyor at a point in advance of the signatures reaching the packer box on the binding line.

18 Claims, 3 Drawing Sheets

SIGNATURE STREAM FEEDING APPARATUS

FIELD OF THE INVENTION

The present invention is generally directed to feeding signatures to a packer box on a binding line and, more particularly, to an apparatus for feeding signatures in a shingled stream from either a loose lift or a signature log.

BACKGROUND OF THE INVENTION

In recent years, many large circulation periodicals have appeared which require rapid handling of portions of the periodicals consisting of signatures which are gathered for binding, trimmed, bundled for minimal shipping costs and shipped. A typical operation utilizes a multitude of packer boxes, each of which receives signatures from a supply, and those signatures are then delivered to a gathering chain or other conveying means by which complete collections of gathered signatures are carried to a location for further processing to complete the binding process. Moreover, because of the need for highly efficient plant operations, there has been a constant effort to increase the speed at which machines operate which has required the development of new techniques for handling the signatures at all stages of the binding process.

In order to achieve these objectives, there have been a variety of attempts to develop an apparatus for feeding the signatures in a shingled stream. Specifically, it is generally known that equipment has been proposed which would hold a large supply of signatures and feed those signatures to a packer box in a stream thus reducing the need for and consequent cost of significant numbers of binding line personnel to continuously supply the packer boxes with signatures. Unfortunately, despite the attempts to achieve such results, there have been a variety of problems that have not to date been fully solved by the various proposals.

In particular, it is generally known that signatures oftentimes are delivered to a binding line in a so-called "signature log." This signature log usually comprises a stack of signatures having boards at opposite ends thereof around which a band or bands are placed to hold the log together for shipment and delivery to a binding line. In many instances, it would be desirable to place the signature log on a stream feeder for delivering the signatures to a packer box.

Currently, it is known that there are several different types of horizontal log feeders of various lengths which are available. These devices typically take up considerable space inasmuch as they are often designed to accept a plurality of such signature logs. Obviously, the need to provide this space is detrimental to the objective of enhancing the efficiency of overall plant operations.

With the horizontal log feeders which have multiple log capacity, it is usually common practice for the last of several logs to remain uncut so as to maintain downstream signature stock in place. The few inadequate attempts to provide a "short" horizontal log feeder have failed inasmuch as a significant number of signatures at the far upstream end of the log typically f all over when the band or bands that hold the log together are cut. As a result, it has remained to provide an apparatus for feeding signatures in a shingled stream from either a loose lift or a single log in a manner that overcomes the problems that are noted in the foregoing.

Thus, the present invention is directed to overcoming one or more of the foregoing problems and achieving one or more of the resulting objects.

SUMMARY OF THE INVENTION

It is a principal object of the present invention in the most general sense to provide an improved apparatus f or feeding signatures to a binding line. It is a further object of the present invention to provide a signature feeding apparatus which is configured to feed signatures in a shingled stream. It is an additional object of the present invention to provide an apparatus for feeding signatures from either a loose lift or a single signature log.

Accordingly, the present invention is directed to a signature stream feeding apparatus having an upstream conveyor, an intermediate conveyor, a downstream conveyor, and means for transforming signatures into a shingled stream.

In the exemplary embodiment, the upstream conveyor receives and supports a supply of signatures in a generally upright position on the fore edges or backbones thereof. It also includes means for conveying the supply of signatures along the upstream conveyor generally toward a packer box on a binding line. With this arrangement, the upstream conveyor is downwardly inclined relative to the horizontal in the direction of travel of the supply of signatures therealong.

As for the intermediate conveyor, it is adapted to receive the signatures from the upstream conveyor. The intermediate conveyor also includes means for conveying the supply of signatures generally away from the upstream conveyor and generally toward the packer box on the binding line. Still additionally, the intermediate conveyor is inclined upwardly and away from the upstream conveyor.

In the exemplary embodiment, the downstream conveyor is adapted to receive the signatures from the intermediate conveyor. The downstream conveyor also includes means for conveying the supply of signatures generally away from the intermediate conveyor and generally toward the packer box on the binding line. With this arrangement, the downstream conveyor extends between the packer box and the intermediate conveyor.

As for the means for transforming the supply of signatures into a shingled stream, it is operatively associated with the conveying means of each of the conveyors, i.e., the upstream conveyor, intermediate conveyor and downstream conveyor. Advantageously, the signature transforming means forms a shingled stream at the intermediate conveyor and a thinner shingled stream at the downstream conveyor at a point in advance of the signatures reaching the packer box on the binding line.

In the preferred embodiment, the upstream conveyor includes a fixed section immediately adjacent the intermediate conveyor as well as a pivotable section on the end of the fixed section opposite the intermediate conveyor which is selectively movable from an operative position to an inoperative position. Also, the intermediate conveyor advantageously has a first end pivotally mounted to the upstream conveyor and a second end pivotally mounted to the downstream conveyor together with means for adjusting the vertical position of the second end thereof. Still additionally, the downstream conveyor is preferably formed so as to extend generally horizontally in an operative position and is mounted to the intermediate conveyor for movement from the generally horizontal operative position to a generally vertical inoperative position.

In another respect, the present invention is directed to an apparatus for feeding signatures in a shingled stream from either a loose lift of signatures or, alternatively, a single signature log. The upstream conveyor is then adapted to receive a loose lift of signatures on the fixed section independent of the position of the pivotable section, and it is also adapted to receive a log of signatures at when the pivotable section is in the operative position thereof. With this arrangement, the signature transforming means is adapted to transform signatures from a loose lift or log into a shingled stream at the intermediate conveyor and into a thinner shingled stream at the downstream conveyor.

Preferably, the signature transforming means includes means for controlling the speed of the conveying means for operating the intermediate conveyor faster than the upstream conveyor and the downstream conveyor faster than the intermediate conveyor. Also, the signature feeding apparatus advantageously includes a level switch for controlling the height of signatures in the packer box wherein the level switch is operatively associated with the conveying means of the upstream, intermediate, and downstream conveyors for controlling operation thereof. In this connection, the conveyors are preferably driven by a continuously running motor wherein clutch means is operatively associated with the continuously running motor so as to be engageable upon demand for conveying the supply of signatures to the packer box.

Other objects, advantages and features of the present invention will become apparent from a consideration of the following specification taken in conjunction with the accompanying drawings.

DETAILED DESCRIPTION OF THE PREFERRED EMBODIMENT

Figure 1:
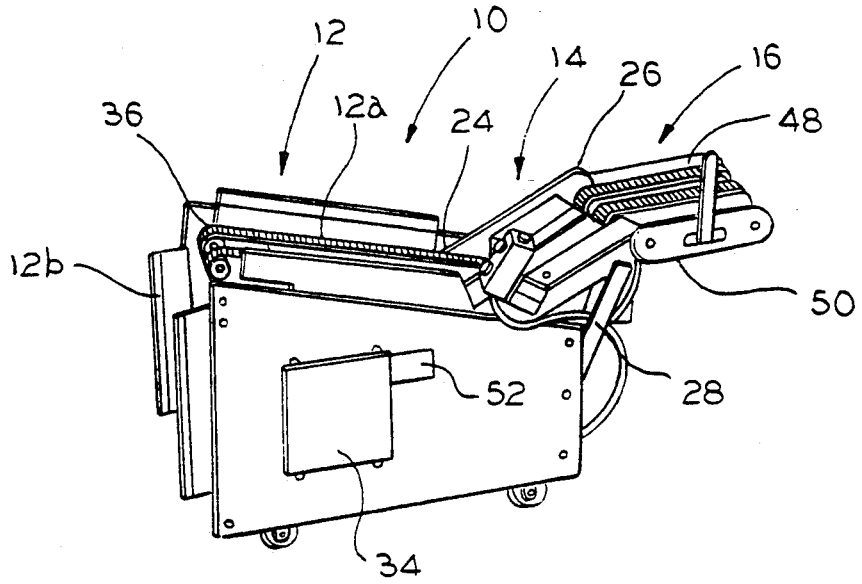
FIG. 1 is a side elevational view of a signature stream feeding apparatus in accordance with the present invention.

Referring to the drawings, and first to FIG. 1, the reference numeral 10 designates generally a signature stream feeding apparatus in accordance with the present invention. The apparatus 10 will be seen to include an upstream conveyor 12, an intermediate conveyor 14, and a downstream conveyor 16. In addition, the apparatus 10 includes means for transforming a supply of signatures into a shingled stream as will be described in greater detail hereinafter.

Figure 2:
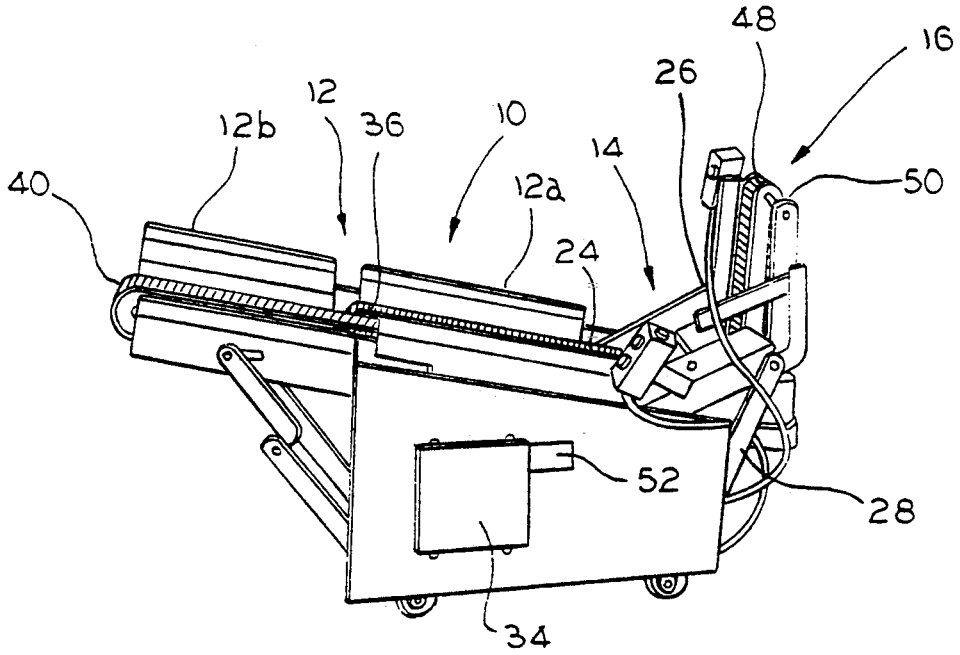
FIG. 2 is a side elevational view similar to FIG. 1 but with a downstream conveyor thereof in an inoperative position.
Figure 3:
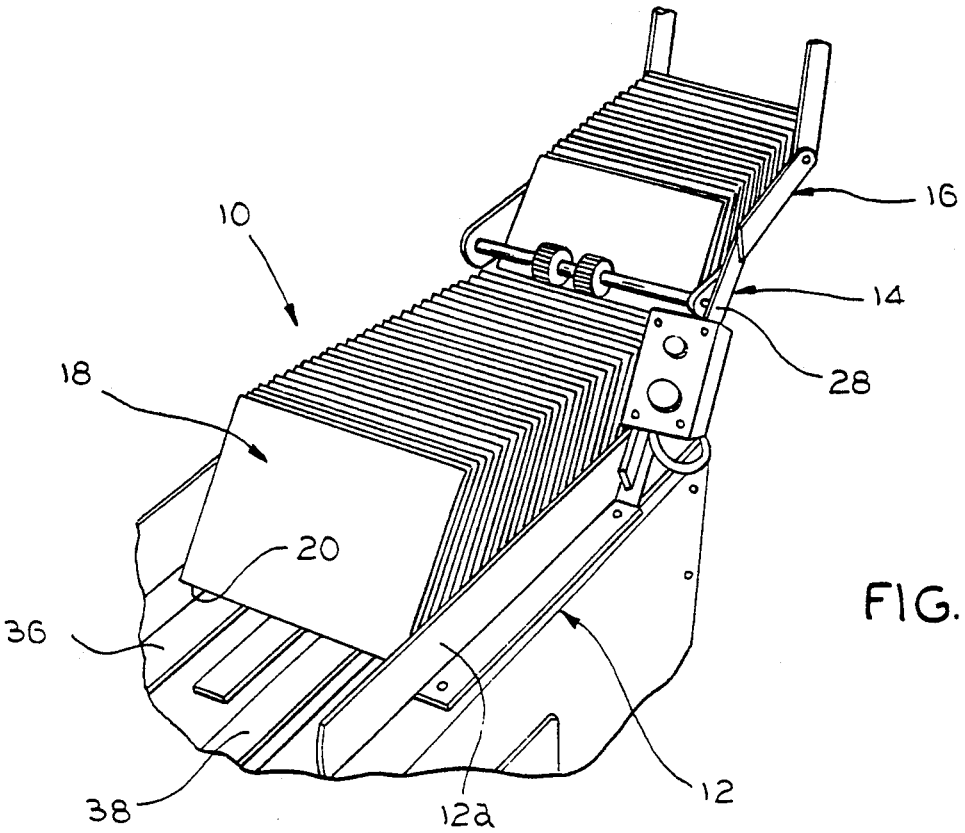
FIG. 3 is a perspective view illustrating signatures being fed into a packer box.

As best shown in FIG. 3, the upstream conveyor 12 is particularly well adapted for receiving and supporting a supply of signatures 18 in a generally upright position on the fore edges or backbones 20 thereof. The upstream conveyor 12 will also be understood to include means for conveying the supply of signatures 18 generally toward a packer box 22 on a binding line. As will be appreciated from FIG. 2, the upstream conveyor 12 is downwardly inclined relative to the horizontal in the direction of travel of the supply of signatures 18 therealong.

Referring again to FIG. 1, the intermediate conveyor 14 is adapted to receive the signatures from the upstream conveyor 12 (see also FIG. 3). The intermediate conveyor 14 also will be understood to include means for conveying the supply of signatures 18 generally away from the upstream conveyor 12 and generally toward the packer box 22 on the binding line. As best shown in FIG. 1, the intermediate conveyor 14 is inclined upwardly and away from the upstream conveyor 12 for a purpose that will be described hereinafter.

Figure 4:
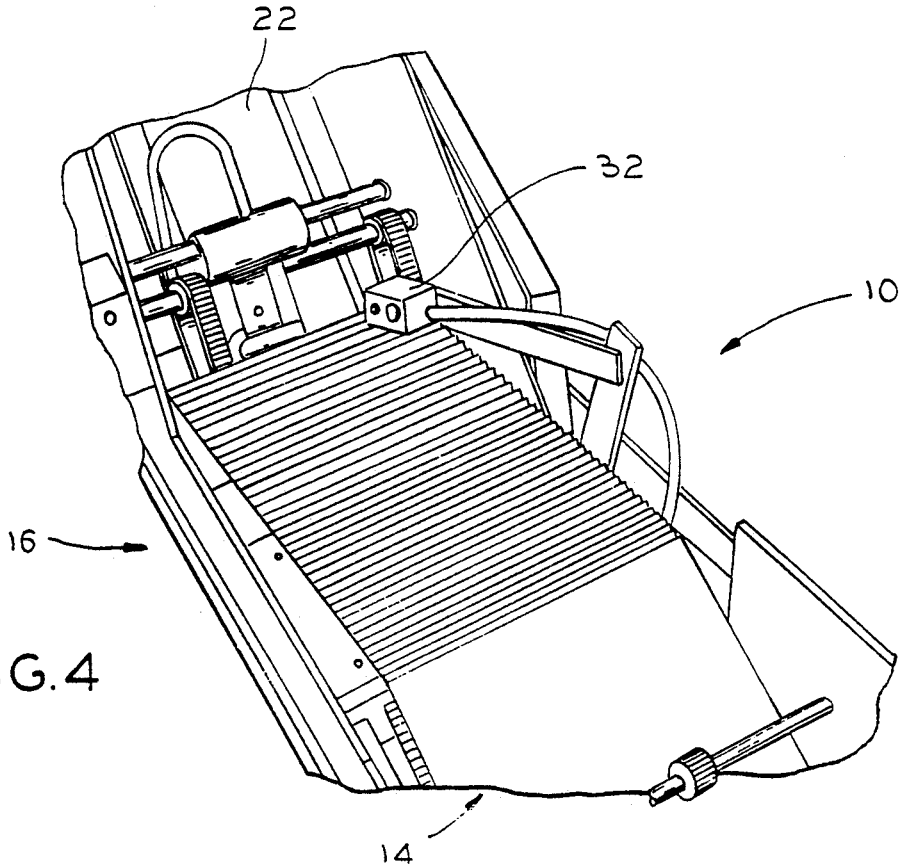
FIG. 4 is a top plan view illustrating signatures being fed into a packer box.

As will be appreciated from the drawings, the downstream conveyor 16 is adapted to receive the signatures from the intermediate conveyor 14 and to serve as a bridge between the intermediate conveyor 14 and the packer box 22 substantially as illustrated. The downstream conveyor 16 will additionally be understood to include means for conveying the supply of signatures 18 generally away from the intermediate conveyor 14 and generally toward the packer box 22 on the binding line. Referring specifically to FIGS. 3 and 4, the downstream conveyor 16 will be seen to extend between the packer box 22 and the intermediate conveyor 14 so as to convey signatures form the intermediate conveyor 14 into the packer box 22 in shingled stream as will be described in further detail hereinafter.

Figure 5:
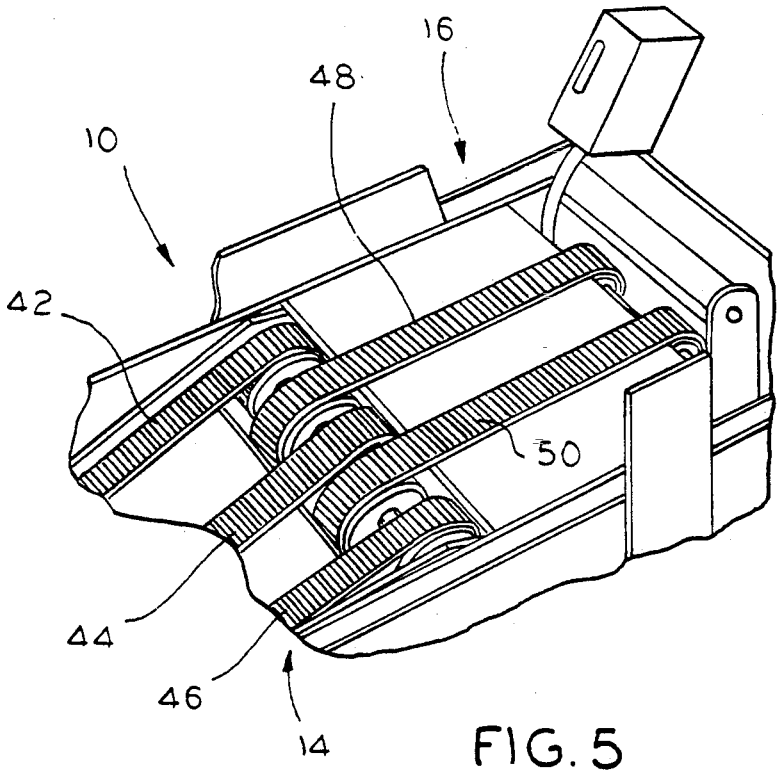
FIG. 5 is a perspective view illustrating the interface between a packer box and a signature stream feeding apparatus.

By comparing FIGS. 1 and 2, it will be seen that the upstream conveyor 12 includes a fixed section 12*a* immediately adjacent the intermediate conveyor 14 and a pivotable section 12*b* generally upstream of the intermediate conveyor 14 which is selectively movable from an operative position (FIG. 2) to an inoperative position (FIG. 1). it will also be seen that the intermediate conveyor 14 has a first end 24 pivotally mounted to the upstream conveyor 12 and, in particular, to the fixed section 12*a* thereof, and a second end 26 pivotally mounted to the downstream conveyor 16 including means such as adjustable support legs 28 for adjusting the vertical position of the second end 26 thereof. As best shown in FIGS. 1 and 5, the downstream conveyor 16 normally extends generally horizontally in an operative position and is mounted to the intermediate conveyor 14 for movement from the generally horizontal operative position to a generally vertical inoperative position (see FIGS. 2 and 6).

Referring to FIG. 3, the signature transforming means includes suitable conventional sprockets so as to operate the intermediate conveyor 14 faster than the upstream conveyor 12 and the downstream conveyor 16 faster than the intermediate conveyor 14. The sprockets may be selected and/or replaced to control the relative speeds at which the conveyors 12, 14 and 16 operate, all of which will be known to those skilled in the art. In this manner, the supply of signatures 18 can be transformed into a shingled stream at the intermediate conveyor 14 (see FIG. 3) and into a thinner shingled stream at the downstream conveyor 16 (see FIG. 4) at a point in advance of the signatures reaching the packer box 22 on the binding line.

As should now be appreciated, the present invention achieves the objective of providing an apparatus for feeding signatures in a shingled stream from either a loose lift or a single signature log since the upstream conveyor 12 is adapted to receive and support either in a generally upright position on the fore edges or backbones thereof. More specifically, the upstream conveyor 12 is adapted to receive a loose lift of signatures on the fixed section 12*a* independent of the position of the pivotable section 12*b* and is adapted to receive a log of signatures when the pivotable section 12*b* is in the operative position thereof (see FIG. 2).

Referring to FIG. 4, it will be seen and appreciated that the apparatus 10 advantageously includes a level switch 32 which serves to control the height of signatures in the packer box 22. It will be understood that the level switch 32 is operatively associated with the conveying means of the upstream, intermediate, and downstream conveyors 12, 14 and 16, respectively,, in such manner as to control the operation thereof. In other words, when the level switch 32 is triggered by the existence of signatures at a desired level in the packer box 22, the operation of the apparatus 10 is stopped until more signatures are needed in the packer box 22.

As shown in the embodiment illustrated in FIGS. 1 and 2, the upstream conveyor 12, intermediate conveyor 14 and downstream conveyor 16 are all driven by means of a motor generally designated 34. This motor 34 shall be a single motor for driving all of the conveyors 12, 14 and 16, which through various sized sprockets will be chain driven to vary the relative speed of the conveyors 12, 14 and 16.

The details of the motor such as 34, and the drive for the conveyors 12, 14 and 16 will be any of a wide variety of conventional types known to those skilled in the art.

Referring to FIGS. 1 and 3, the upstream conveyor 12 will be seen to comprise a steel chain conveyor with the fixed section 12*a* having a pair of steel conveying chains 36 and 38 and the pivotable section 12*b* having a single steel conveying chain 40 generally centered therebetween (see FIG. 2). Furthermore, the intermediate and downstream conveyors 14 and 16 will be seen to comprise rubber belted conveyor with the intermediate conveyor 14 having three rubber conveying belts 42, 44 and 46 and the downstream conveyor 16 having two rubber conveying belts 48 and 50.

As will be appreciated, the steel conveying chains 36, 38 and 40 are well suited for receiving and supporting a loose lift or log of signatures as they are conveyed toward the upstream conveyor 14, the rubber conveying belts 42, 44 and 46 serve well to create the shingled stream at the intermediate conveyor 14, and the rubber conveying belts 48 and 50 serve well to create the thinner shingled stream at the downstream conveyor 16 as the signatures travel toward the packer box 22 as described in greater detail hereinabove.

Referring once again to FIG. 1, and as previously discussed, the upstream, intermediate and downstream conveyors 12, 14, and 16 are each driven by a continuously running motor such as 34. The apparatus 10 then includes clutch means 52, which may take the form of any conventional clutch for engaging and disengaging the motor 34 from the drive means for the conveyors 12, 14 and 16. More specifically, the clutch means 52 is operatively associated with the continuously running motor such as 34 and is engageable on demand for conveying the supply of signatures 18 to the packer box 22.

In practice, the upstream conveyor 12 is downwardly inclined relative to the horizontal by an angle of approximately 15 degrees. This allows a single signature log to remain intact even after the band or bands have been cut and the boards removed. In addition, the angle of downward inclination of the upstream conveyor, 12 will be understood to add a gravity assist to the signature feeding process.

As previously mentioned, the pivotable section 12*b* can be folded down to an inoperative position in which it is generally vertical (see FIG. 1) . This allows for more compact operation, e.g., where loose lifts are placed on the fixed section 12*a*, and also provides for more compact storage, e.g., in the event the packer box 22 is to be manually filled. Moreover, the pivotable section 12*b* can be raised to its operative position for more ergonomic feeding of loose lifts or placement of a single signature log thereon.

As for the adjustment of the vertical position of the second end 26 of the intermediate conveyor 14, this can be accomplished in the manner that has been previously described by utilizing the adjustable support legs 28. It will be understood that the intermediate conveyor 14 not only creates a shingled stream of signatures but, by being able to adjust the vertical position of the second end 26 thereof, it is possible to allow for variations in the height of the pocket in the packer box 22. Still additionally, the downstream conveyor 16 can be made to feed directly into the packer box 22 in a generally horizontal orientation by securing it to the packer box 22 by any conventional fastening means.

Figure 6:
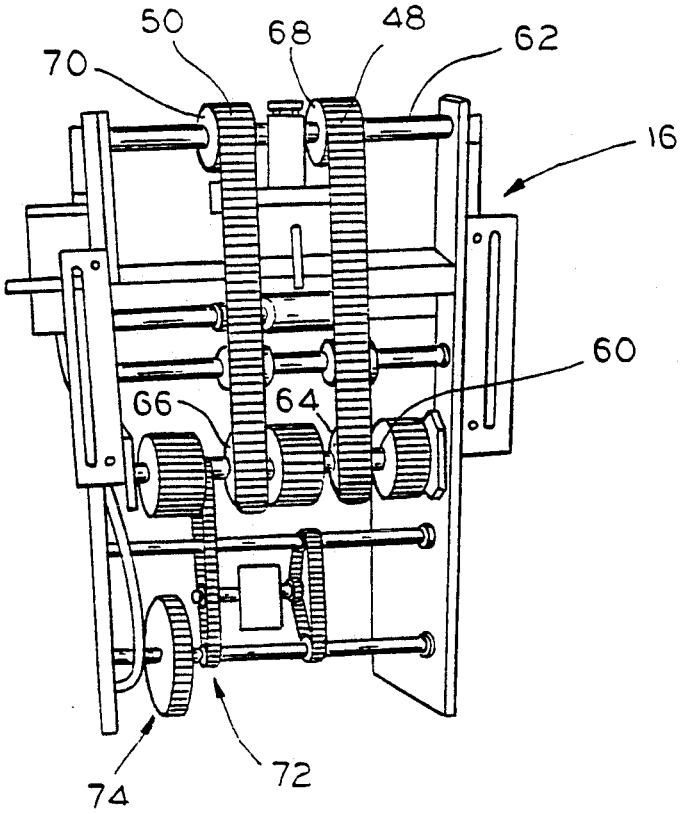
FIG. 6 is a front elevational view of the signature stream feeding apparatus with the downstream conveyor in an inoperative position.

While not important for an understanding of the present invention, FIG. 6 illustrates some drive components for the downstream conveyor which are representative of those that can be utilized for all of the conveyors as will readily be appreciated by those skilled in the art. It will be seen and appreciated in this connection that the apparatus 10 may include axles 60 and 62 having belt pulleys such as 64, 66, 68 and 70 mounted thereon about which the continuous belts 48 and 50 extend. With this arrangement, a chain and sprocket drive arrangement generally designated 72 may be interconnected with the motor such as 34 by means of another chain and sprocket drive arrangement generally designated 74 so as to impart drive from the motor 34 through the downstream conveyor 16.

Of course, similar components can be provided in connection with the upstream conveyor 12 and the intermediate conveyor 14 although it should be understood that these components are merely illustrative of an arrangement which can be employed for purposes of imparting drive to the chains and/or belts of the conveyors 12, 14 and 16.

While in the foregoing there has been set forth a preferred embodiment of the invention, it will be appreciated that the details herein given may be varied by those skilled in the art without departing from the true spirit and scope of the appended claims.

We claim:

1. A signature stream feeding apparatus, comprising:

an upstream conveyor for receiving and supporting a supply of signatures in a generally upright position on the fore edges or backbones thereof, said upstream conveyor including means for conveying said supply of signatures generally toward a packer box on a binding line, said upstream conveyor being fixed in a downwardly inclined position relative to the horizontal during operation in the direction of travel of said supply of signatures therealong;

an intermediate conveyor for receiving said signatures from said upstream conveyor, said intermediate conveyor including means for conveying said supply of signatures generally away from said upstream conveyor and generally toward said packer box on said binding line, said intermediate conveyor being fixed in an upwardly inclined position during operation and extending away from said upstream conveyor;

a downstream conveyor for receiving said signatures from said intermediate conveyor, said downstream conveyor including means for conveying said supply of signatures generally away from said intermediate conveyor and generally toward said packer box on said binding line, said downstream conveyor extending between said packer box and said intermediate conveyor; and means associated with said conveying means of said upstream, intermediate and downstream conveyors for transforming said supply of signatures into a shingled stream at said intermediate conveyor and into a thinner shingled stream at said downstream conveyor at a point in advance of said signatures reaching said packer box on said binding line.

2. The signature stream feeding apparatus of claim 1 wherein said upstream conveyor includes a fixed section immediately adjacent said intermediate conveyor and a pivotable section generally upstream of said intermediate conveyor selectively movable from an operative position to an inoperative position.

3. The signature stream feeding apparatus of claim 1 wherein said intermediate conveyor has a first end pivotally mounted to said-upstream conveyor and a second end pivotally mounted to said downstream conveyor including means for adjusting the vertical position of said second end thereof.

4. The signature stream feeding apparatus of claim 1 wherein said downstream conveyor normally extends generally horizontally in an operative position and is mounted to said intermediate conveyor for movement from said generally horizontal operative position to a generally vertical inoperative position.

5. The signature stream feeding apparatus of claim 1 wherein said signature transforming means includes means f or operating said intermediate conveyor faster than said upstream conveyor and said downstream conveyor faster than said intermediate conveyor.

6. A signature stream feeding apparatus comprising:

an upstream conveyor for receiving and supporting a supply of signatures in a generally upright position on the fore edges or backbones thereof, said upstream conveyor including means for conveying said supply of signatures generally toward a packer box on a binding line, said upstream conveyor being fixed in a downwardly inclined position relative to the horizontal during operation in the direction of travel of said supply of signatures therealong;

an intermediate conveyor for receiving said signatures from said upstream conveyor, said intermediate conveyor including means for conveying said supply of signatures generally away from said upstream conveyor and generally toward said packer box in said binding line, said intermediate conveyor being fixed in an upwardly inclined position during operation and extending away from said upstream conveyor;

said upstream conveyor including a permanently fixed section immediately adjacent said intermediate conveyor and a pivotable section generally upstream of said intermediate conveyor selectively movable to said downwardly inclined operative position to an inoperative position;

a downstream conveyor for receiving said signatures from said intermediate conveyor, said downstream conveyor including means for conveying said supply of signatures generally away from said intermediate conveyor and generally toward said packer box on said binding line, said downstream conveyor extending between said packer box and said intermediate conveyor;

said downstream conveyor normally extending generally horizontally in an operative position and being mounted to said intermediate conveyor for movement from said generally horizontal operative position to a generally vertical inoperative position; and means associated with said conveying means of said upstream, intermediate and downstream conveyors for transforming said supply of signatures into a shingled stream at said intermediate conveyor and into a thinner shingled stream at said downstream conveyor at a point in advance of said signatures reaching said packer box on said binding line.

7. The signature stream feeding apparatus of claim 6 wherein said intermediate conveyor has a first end pivotally mounted to said upstream conveyor and a second end pivotally mounted to said downstream conveyor including means for adjusting the vertical position of said second end thereof.

8. The signature stream feeding apparatus of claim 6 wherein said signature transforming means includes means for operating said intermediate conveyor faster than said upstream conveyor and said downstream conveyor faster than said intermediate conveyor.

9. The signature stream feeding apparatus of claim 6 including a level switch for controlling the height of signatures in said packer box, said level switch being operatively associated with said conveying means of said upstream, intermediate, and downstream conveyors for controlling operation thereof.

10. The signature stream feeding apparatus of claim 9 wherein said conveyors are driven by a continuously running motor and including clutch means operatively associated with said continuously running motor and engageable on demand for conveying said supply of signatures to said packer box.

11. The signature stream feeding apparatus of claim 6 wherein said upstream conveyor is motor driven and includes a steel chain conveyor in each of said fixed and pivotable sections and said intermediate conveyor and said downstream conveyor are each motor driven and each included a rubber belted conveyor.

12. An apparatus for feeding signatures in a shingled stream from either a loose lift or a single signature log, comprising:

an upstream conveyor for receiving and supporting a loose lift or log of signatures in a generally upright position on the fore edges or backbones thereof, said upstream conveyor including means for conveying said signatures generally toward a packer box on a binding line, said upstream conveyor being fixed in a downwardly inclined position relative to the horizontal during operation in the direction of travel of said signatures therealong;

an intermediate conveyor for receiving said signatures from said upstream conveyor, said intermediate conveyor including means for conveying said signatures generally away from said upstream conveyor and generally toward said packer box on said binding line, said intermediate conveyor being fixed in an upwardly inclined position during operation and extending away from said upstream conveyor;

said upstream conveyor including a fixed section immediately adjacent said intermediate conveyor and a pivotable section generally upstream of said intermediate conveyor selectively movable from said downwardly inclined operative position to an inoperative position, said upstream conveyor being adapted to receive a loose lift of signatures on said fixed section independent of the position of said pivotable section and being adapted to receive a log of signatures when said pivotable section is in said downwardly inclined operative position thereof;

a downstream conveyor for receiving said signatures from said intermediate conveyor, said downstream conveyor including means for conveying said signatures generally away from said intermediate conveyor and generally toward said packer box on said binding line, said downstream conveyor extending between said packer box and said intermediate conveyor;

said downstream conveyor normally extending generally horizontally in an operative position and being mounted to said intermediate conveyor for movement from said generally horizontal operative position to a generally vertical inoperative position; and means associated with said conveying means of said upstream, intermediate and downstream conveyors for transforming said signatures from a loose lift or log into a shingled stream at said intermediate conveyor and into a thinner shingled stream at said downstream conveyor at a point in advance of said signatures reaching said packer box on said binding line.

13. The signature feeding apparatus of claim 12 wherein said intermediate conveyor has a first end pivotally mounted to said upstream conveyor and a second end pivotally mounted to said downstream conveyor including means for adjusting the vertical position of said second end thereof.

14. The signature feeding apparatus of claim 12 wherein said signature transforming means includes means for operating said intermediate conveyor faster than said upstream conveyor and said downstream conveyor faster than said intermediate conveyor.

15. The signature feeding apparatus of claim 12 including a level switch for controlling the height of signatures in said packer box, said level switch being operatively associated with said conveying means of said upstream, inter-mediate, and downstream conveyors for controlling operation thereof.

16. The signature feeding apparatus of claim 12 wherein said upstream conveyor is motor driven and includes a steel chain conveyor in each of said fixed and pivotable sections and said intermediate conveyor and said downstream conveyor are also each motor driven and each include a rubber belted conveyor.

17. The signature feeding apparatus of claim 12 wherein each of said conveyors is driven by a continuously running motor and including clutch means operatively associated with said continuously running motor and engageable on demand for conveying said supply of signatures to said packer box.

18. The signature feeding apparatus of claim 12 wherein said upstream conveyor is downwardly inclined in the direction of travel of said signatures relative to the horizontal by an angle of approximately 15 degrees.

* * * * *